US005662462A

United States Patent [19]

Paley et al.

[11] Patent Number: 5,662,462

[45] Date of Patent: Sep. 2, 1997

[54] SEALING ARRANGEMENT FOR A HYDRAULIC MOTOR AND PUMP

[75] Inventors: Edward D. Paley, Grosse Pointe; Kerry A. MacHesney, Farmington Hills; Eugene S. Tarrence, Warren, all of Mich.

[73] Assignee: Hydraulic Power Systems, Inc., Oak Park, Mich.

[21] Appl. No.: 476,012

[22] Filed: Jun. 7, 1995

[51] Int. Cl.[6] ..... F01C 1/04

[52] U.S. Cl. ..... 418/61.3; 418/102; 418/171; 277/39

[58] Field of Search ..... 418/61.3, 102, 418/104, 171; 277/35, 38, 39, 81 R; 384/489

[56] References Cited

U.S. PATENT DOCUMENTS

| | | | |
|---|---|---|---|
| 2,405,061 | 7/1946 | Shaw | 418/171 |
| 3,188,969 | 6/1965 | Brundage | 418/171 |
| 3,431,863 | 3/1969 | Waldorff | 418/61.3 |
| 3,547,565 | 12/1970 | Eddy | 418/61.3 |
| 3,695,791 | 10/1972 | Brundage | 418/171 |
| 3,966,367 | 6/1976 | Erickson et al. | 418/58 |
| 4,153,400 | 5/1979 | Morita | 418/102 |
| 5,314,319 | 5/1994 | Nilsson et al. | 418/170 |

*Primary Examiner*—Charles G. Freay
*Attorney, Agent, or Firm*—Young & Basile, P.C.

[57] ABSTRACT

A hydraulic motor that provides an improved sealing configuration for sealing a shaft with respect to a housing of an internal gear motor or pump of the type commonly known as a gerotor. The hydraulic motor provides a housing having an output end and an input end with an opening extending therebetween. A gerotor is connected to the input end of the housing, and a cover is connected to and covers the gerotor while also receiving and rotatably supporting an end of the shaft. An inlet port and an outlet port are provided in the cover for communicating hydraulic fluid to and from the gerotor. A large roller bearing is coupled to the shaft and disposed within the opening of the housing to rotatably support the shaft. For high pressure applications, a pair of conventional mechanical face seals are coupled to the shaft and disposed within the opening of the housing. A third conventional lip seal may also be utilized as an added level of sealing the shaft with respect to the housing. For low pressure applications, the lip seal is utilized without the mechanical face seals. A means for draining excess fluid and relieving excess hydraulic pressures may also be provided for high pressure applications. A passageway extending through a side wall of the housing and through a bearing/seal support may be provided to drain hydraulic fluid from predetermined areas within the housing to an external fluid reservoir.

10 Claims, 4 Drawing Sheets

SEALING ARRANGEMENT FOR A HYDRAULIC MOTOR AND PUMP

FIELD OF THE INVENTION

The present invention relates to hydraulic motors, and more particularly, to a sealing arrangement for sealing an output shaft to a housing of an internal gear motor or pump of the type commonly known as gerotors.

BACKGROUND OF THE INVENTION

Although the invention is particularly applicable to internal gear or gerotor type motors and will be described with particular reference thereto, it should be noted that the present invention has broader applications and may be employed with other types of hydraulic devices, including pumps, such as gerotor type pumps.

Hydraulic devices of the type to which this invention is applicable are normally comprised of a housing, a fluid cavity in the housing and a shaft extending into and rotatably supported in the housing. Conventional gerotors provide an internally toothed ring gear and an externally toothed pinion gear that are disposed in the cavity of the housing and rotate with the shaft in a bearing surface eccentric to the axis of the shaft to define a plurality of increasing to decreasing volume fluid chambers. Inlet and outlet ports are formed in the housing and communicate with these chambers. Normally, when functioning as a motor, the chambers increasing in volume communicate with an inlet port at relatively high hydraulic pressures while the chambers decreasing in volume communicate with an outlet port and are at relatively low hydraulic pressures.

The high hydraulic pressures that are utilized to power gerotors are also utilized to fill passageways and cavities of the hydraulic motor for lubricating the necessary portions of the shaft and any bearing utilized to rotatably support the shaft. Because these high pressures utilized to power gerotors often reach levels of 1000 psig, it is difficult to effectively seal the shaft to the housing without having some amount of hydraulic fluid travel pass the seals along the shaft. Thus, it would be desirable to provide a sealing arrangement that could reliably and effectively seal a shaft of a hydraulic motor when exposed to high hydraulic pressures commonly utilized in gerotor type motors.

In many applications, such as automobiles, any amount or type of fluid leaking from such a hydraulic motor or pump cannot be tolerated. Therefore, it would be desirable to provide a hydraulic motor of the gerotor type that provided a draining means for receiving any fluid that may pass by the sealing means for sealing the shaft with respect to the housing and direct such fluid to a fluid reservoir.

The problem of sealing the shaft with respect to the housing is enhanced when dynamic forces are applied to the various parts of the hydraulic motor. For example, the shaft of the hydraulic motor is commonly connected to a means for accomplishing work, such as a pulley, spline, gear, shaft, etc. When this occurs, the shaft realizes lateral forces, especially in the instance of a pulley. If the shaft is not properly supported to withstand the lateral loads of a pulley, the sealing means for sealing the shaft with respect to the housing may become displaced, thus, degrading the sealing engagement of the shaft relative to the housing. Lack of proper support to the shaft against lateral loads may also lead to degradation of the motor's performance and, ultimately, to the degradation and failure of the internal mechanisms of the hydraulic motor.

Therefore, it would be desirable to provide a hydraulic motor of the gerotor type that properly supports a shaft from lateral loads in order to properly maintain a sealing engagement with the shaft relative to the housing and ensure the proper performance and functioning of the internal mechanisms of the hydraulic motor.

SUMMARY OF THE INVENTION

The present invention solves the above shortcomings by providing a hydraulic motor of the gerotor type that provides a unique sealing arrangement for sealing a shaft with respect to a housing of the hydraulic motor wherein hydraulic fluid is provided to the hydraulic motor at a high hydraulic pressure as commonly utilized in gerotor type motors. The present invention also provides a draining means for receiving excess hydraulic fluid and relieving hydraulic pressure from within the housing of the hydraulic motor. The present invention also rotatably supports the shaft against lateral loads so that the sealing configurations maintain their sealing engagements by maintaining the position of the shaft relative to a longitudinal axis of the housing.

The hydraulic motor of the present invention provides a housing having an output end and an input end with an opening extending therebetween. A shaft extends through the opening of the housing and has an input end extending beyond the input end of the housing and an output end extending beyond the output end of the housing. A conventional gerotor is connected to the input end of the housing and has an outer tooth gear coaxially mounted to the shaft and an inner tooth gear eccentrically mounted with respect to the shaft so that the inner tooth gear meshes with the outer tooth gear to form a plurality of actuating chambers. A cover is connected to the gerotor and receives and rotatably supports the input end of the shaft. A means for communicating a hydraulic fluid to and from the actuating chambers of the gerotor is provided to drive the meshing gears of the gerotor.

A means for rotatably supporting the shaft is provided within the housing of the hydraulic motor to support the shaft from lateral loads and thus maintain proper engagement of the sealing configurations. A means for sealing the shaft with respect to the opening of the housing is disposed within the opening of the housing and is spaced along a longitudinal axis of the housing between the rotatable supporting means and the output end of the housing.

In the preferred embodiment, the hydraulic motor of the present invention is utilized for high hydraulic pressure applications. Thus, the sealing means provides a first and second mechanical face seal for sealing the shaft with respect to the opening of the housing. The pair of mechanical face seals are disposed within the opening of the housing and are spaced along the longitudinal axis of the housing between the rotatable supporting means and the output end of the housing. A means for draining excess fluid is provided by a passageway extending through the housing and through a bearing/seal support. The draining means drains off fluid that has accumulated in the opening between the first mechanical face seal and the rotatable supporting means. The draining means also relieves any hydraulic pressure that may accumulate within the opening of the housing.

In another embodiment, a third seal is added to seal the shaft with respect to the opening of the housing. The third seal is disposed within the opening of the housing and spaced along the longitudinal axis of the housing between the second mechanical face seal and the output end of the housing. A compartment for accumulating excess fluid that escapes the first and second mechanical face seals is provided between the second mechanical face seal and the third seal. In this form, the draining means provides a passageway that extends through the housing and through the bearing/seal support for draining excess fluid that may accumulate in the compartment.

In yet another embodiment, the hydraulic motor is utilized for low hydraulic pressure applications, and therefore, only one seal is utilized to seal the shaft from the opening of the housing. A means for draining excess fluid from the opening of the housing is not provided due to the low pressure utilized within the hydraulic motor.

To this end, the objects of the present invention are to provide a new and improved hydraulic motor of the gerotor type having a seal configuration that seals a shaft with respect to a housing of the hydraulic motor for a wide range of hydraulic pressures; and a new and improved hydraulic motor of the gerotor type having a draining means for draining excess fluid that has accumulated in undesirable locations of the housing.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 5:
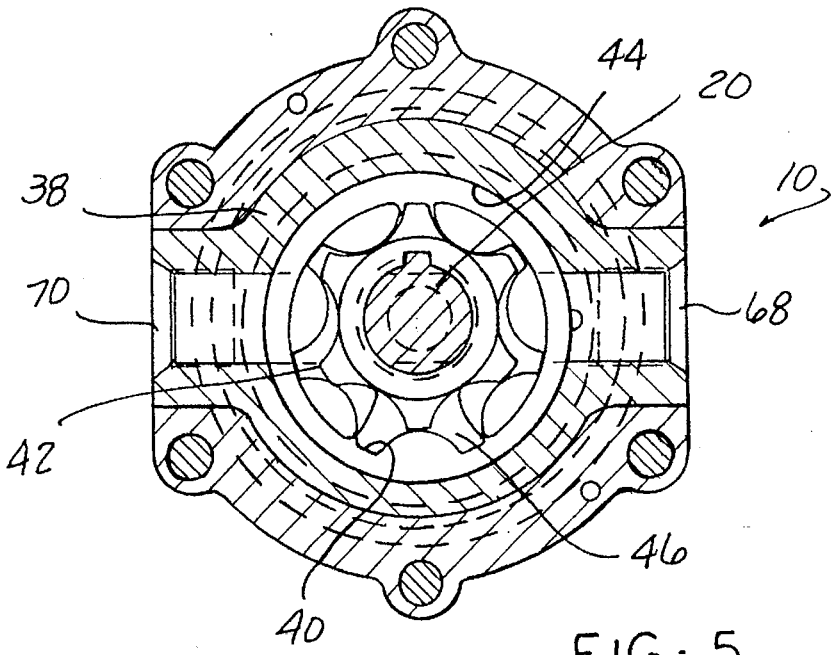
FIG. 5 is a section view taken in the direction of arrows 5—5 in FIG. 4 showing the meshing of the inner tooth gear and the outer tooth gear of the gerotor.

As seen in FIGS. 1, 2, 4 and 6, the hydraulic motor 10 of the present invention provides a housing 12 with an opening 14 extending between an output end 16 and an input end 18 of the housing 12. A shaft 20 extends through the opening 14 and is coaxially mounted along a longitudinal axis 22 of the housing 12. A conventional gerotor 24 is connected to the input end 18 of the housing 12, and a cover 26 is connected to and covers the gerotor 24. The cover 26 also receives and rotatably supports an input end 28 of the shaft 20 which extends beyond the input end 18 of the housing 12. In addition, the cover 26 provides a means for communicating hydraulic fluid (not shown) to and from the gerotor 24.

The housing 12 of the hydraulic motor 10 has a substantially cylindrical configuration with a smaller diameter cylindrical portion 30 at the output end 16 of the housing 12 and a larger diameter cylindrical portion 32 at the input end 18 of the housing 12. The opening 14 in the housing 12 is cylindrically bored through the housing 12 wherein the cylindrical opening 14 has a larger diameter portion 34 extending from the output end 16 of the housing 12 and a smaller diameter cylindrical opening 36 extending through the input end 18 of the housing 12. Both of the openings 34, 36 are coaxially aligned with the longitudinal axis 22 of the housing 12.

As seen in FIG. 5, the gerotor 24 has a stationary annular frame member 38 that houses an inner tooth gear 40 and an outer tooth gear 42 and provides an annular bearing surface 44 by which the inner tooth gear 40 may rotate therein. The outer tooth gear 42 is coaxially mounted to the shaft 20, and the inner tooth gear 40 is eccentrically mounted relative to the shaft 20. The inner tooth gear 40 has one less tooth than the outer tooth gear 42 so that the inner tooth gear 40 meshes with the outer tooth gear 42 to form a plurality of actuating chambers 46.

Figure 1:
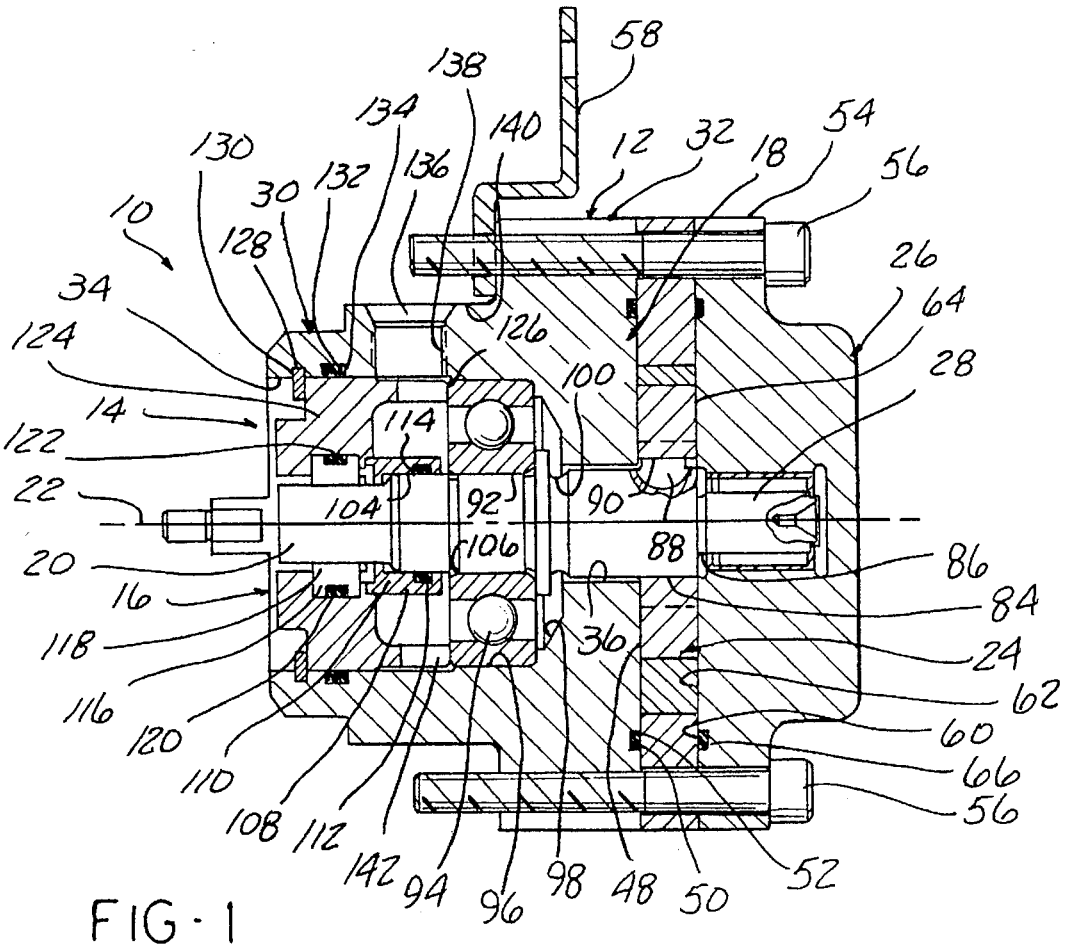
FIG. 1 is a sectional view with some parts broken away showing the two mechanical face seals and a draining means of the hydraulic motor utilized for high hydraulic pressures.
Figure 2:
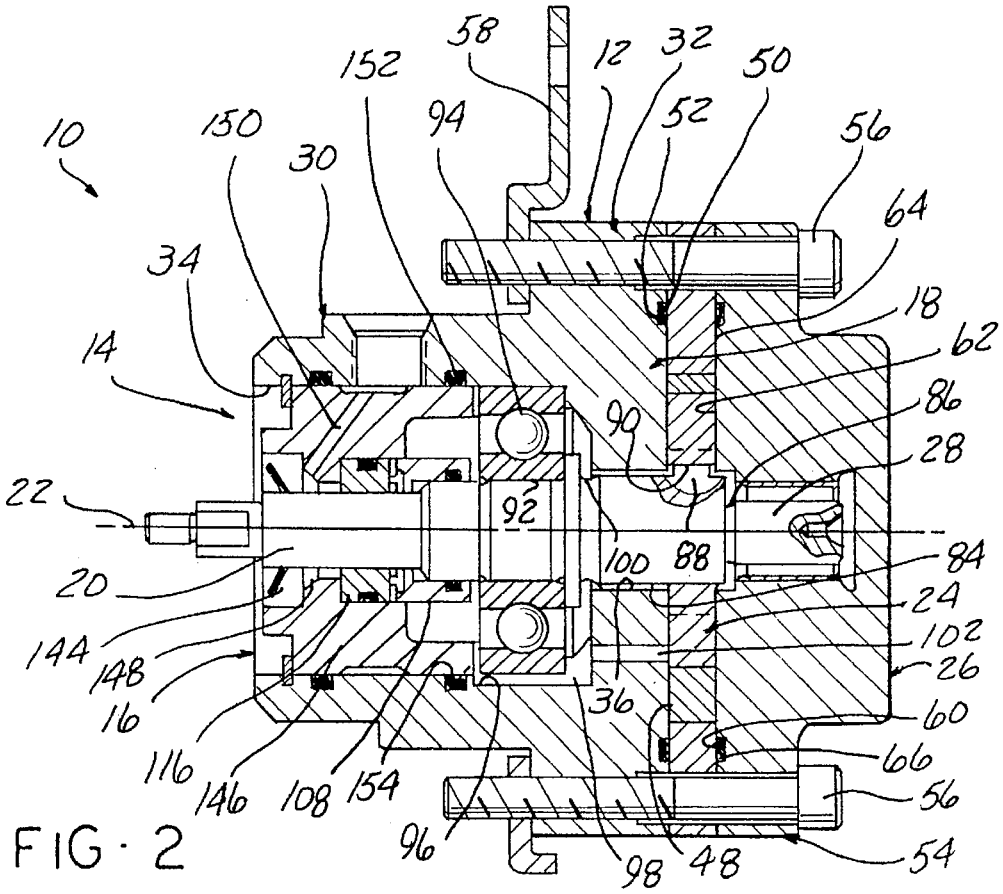
FIG. 2 is a sectional view with some parts broken away showing the two mechanical face seals and a lip seal in combination with a draining means of the hydraulic motor utilized for high hydraulic pressures.
Figure 3:
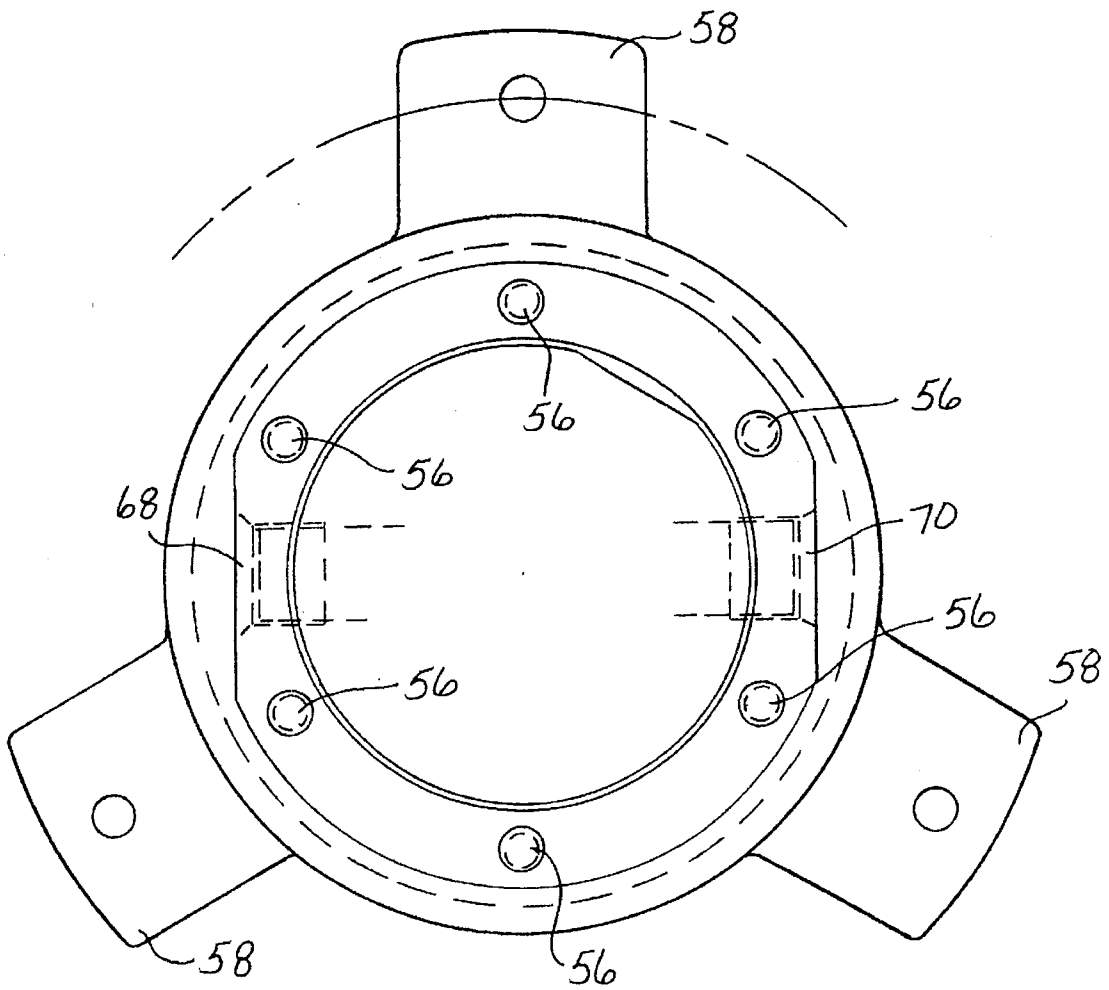
FIG. 3 is an end view of the hydraulic motor shown in FIGS. 1 and 2.

In order to connect the gerotor 24 to the input end 18 of the housing 12, the annular frame member 38 of the gerotor 24 has a substantially flat front side 48 that abuts the input end 18 of the housing 12 which is also substantially flat, as seen in FIGS. 1, 2, 4 and 6. An annular groove 50 is provided in the input end 18 of the housing 12, and a flexible O-ring 52 is seated in the groove 50 of the housing 12 to provide a seal between the input end 18 of the housing 12 and the annular frame member 38 of the gerotor 24. Six commonly aligned apertures (not shown) are provided through the input end 18 of the housing 12, the annular frame member 38 of the gerotor 24 and a flange portion 54 of the cover 26. Six bolts 56 extend through the commonly aligned apertures to fixedly connect the housing 12, gerotor 24 and cover 26 to one another. As seen in FIGS. 1–3, three mounting flanges 58 may be connected to the housing 12 by three of the six bolts 56 utilized to assemble the housing 12, gerotor 24 and cover 26. The mounting flanges 58 allow the hydraulic motor 10 to be supported or carried by an external support structure (not shown).

As seen in FIGS. 1, 2, 4 and 6, an annular groove 60 is also provided in a substantially flat front side 62 of the cover 26 which abuts a substantially flat back side 64 of the annular frame member 38 of the gerotor 24. A flexible O-ring 66 is seated in the groove 60 of the cover 26 so that upon the tightening of the six bolts 56, the flexible O-ring 66 deforms to provide a sealing engagement between the annular frame member 38 of the gerotor 24 and the cover 26.

Figure 6:
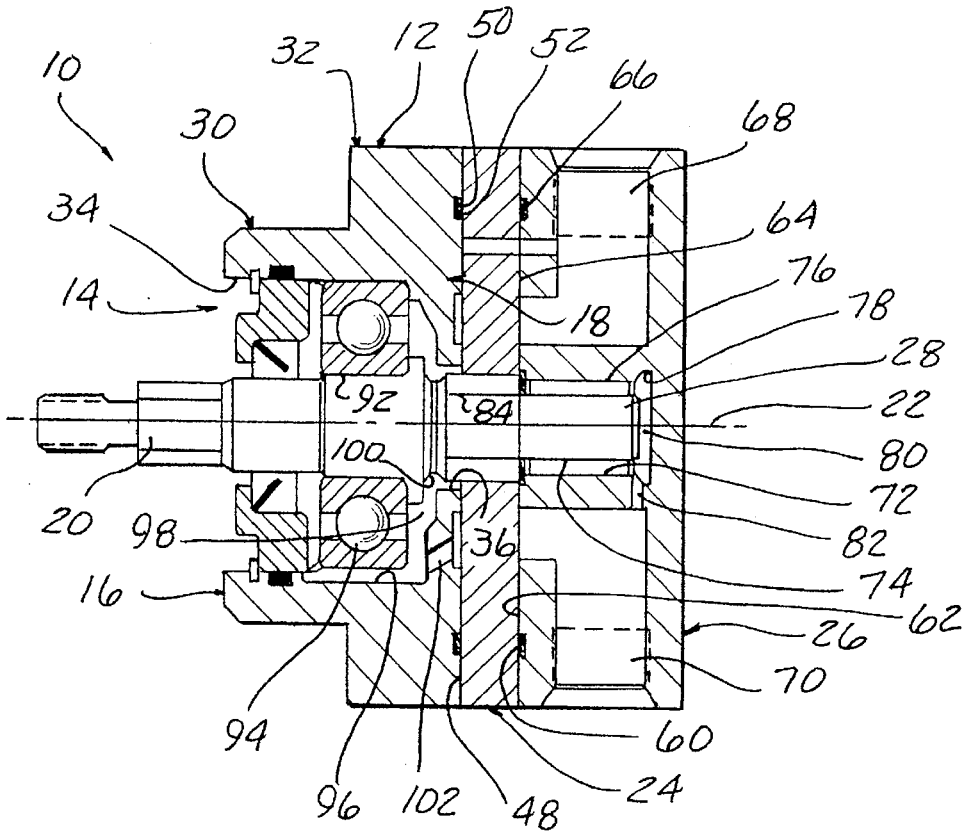
FIG. 6 is a sectional view showing the inlet port and the outlet port of the hydraulic motor shown in FIG. 4.

To communicate hydraulic fluid to the actuating chambers 46 of the gerotor 24, the cover 26 provides an inlet port 68 and an outlet port 70. The inlet port 68 provides a passageway through the cover 26 and into the actuating chambers 46 of the gerotor 24, as seen in FIG. 6. The outlet port 70 extends through the cover 26 and similarly provides a passageway for communicating hydraulic fluid from the actuating chambers 46 of the gerotor 24 to a hydraulic fluid reservoir (not shown). As seen in FIGS. 3 and 5, the inlet port 68 and the outlet port 70 are spaced 180° apart relative to the meshing gears 40, 42 of the gerotor 24 in order to correspond with the expansion and contraction of the actuating chambers 46, formed by the meshing gears 40, 42 of the gerotor 24.

To rotatably support the shaft 20, the shaft 20 extends through the opening 14 of the housing 12 and is coaxially aligned with the longitudinal axis 22 of the housing 12, as seen in FIGS. 1, 2, 4 and 6. The input end 28 of the shaft 20 extends beyond the input end 18 of the housing 12 and is received by a cylindrical bore 72 provided in the cover 26. A first journal 74 of the shaft 20 is rotatably supported within the bore 72 by a rotatable supporting means 76, such as a roller bearing or a bushing. The bottom of the bore 72 has a small outward taper 78 to form a small fluid reservoir 80 for accumulating hydraulic fluid to lubricate the rotatable supporting means 76 within the bore 72 of the cover 26. A small passageway 82 may be provided to place the outlet port 70 in communication with the small fluid reservoir 80 provided in the bore 72 of the cover 26, as seen in FIG. 6.

To couple the shaft 20 with the gerotor 24, the first journal 74 of the shaft 30 extends from the bore 72 of the cover 26 to a larger diameter portion or second journal 84 of the shaft 20 which is connected by a thinner necking portion 86 of the shaft 20. The thinner necking portion 86 allows for hydraulic fluid to communicate between the bore 72 of the cover 26 and the second journal 84 of the shaft 20. The second journal 84 of the shaft 20 is coupled to the outer tooth gear 42 of the gerotor 24 by having a substantially rectangular key 88 on the shaft 20 insert through a key way 90 in the inside diameter of the outer tooth gear 42. The second journal 84 of the shaft 20 extends through the inner diameter of the outer tooth gear 42 of the gerotor 24 and through the smaller cylindrical opening 36 provided in the input end 18 of the housing 12. A small amount of clearance is provided between the small cylindrical opening 36 in the input end 18 of the housing 12 and the second journal 84 of the shaft 20 to allow for hydraulic fluid to pass between the second journal 84 of the shaft 20 and the smaller cylindrical opening 36 in the housing 12 to provide lubrication.

To rotatably support the shaft 20, a third journal 92 is provided on the shaft 20 and is spaced along the longitudinal axis 22 between the output end 16 of the housing 12 and the second journal 84. A large ball bearing 94 is coupled with the third journal 92 of the shaft 20 and is seated against the inner walls 96 of the housing 12 to support the shaft 20 against lateral loads that may be applied to an output end 97 of the shaft 20 which extends beyond the output end 16 of the housing 12. A recess 98 is provided in the housing 12 adjacent the ball bearing 94 to allow for the accumulation of hydraulic fluid to lubricate the ball bearing 94. A narrow necking region 100 is provided on the shaft 20 between the second journal 84 and the third journal 92 of the shaft 20 to communicate hydraulic fluid between the recess 98 and the gerotor 24. A small passageway 102 may be provided through the housing 12 to communicate additional hydraulic fluid between the recess 98 and the gerotor 24.

In the preferred embodiment, hydraulic fluid is communicated to and from the gerotor 24 under high hydraulic pressure, such as 1000 psig. Since hydraulic fluid is placed in communication throughout the hydraulic motor 10 by various passageways and reservoirs, the high hydraulic pressure provided at the inlet port 18 pressurizes the hydraulic fluid within the lubricated passageways and reservoirs of the hydraulic motor 10. Due to the high pressures of the hydraulic fluid, it is difficult to maintain sealing engagements within the hydraulic motor 10 so that the hydraulic fluid can be retained within the housing 12 without escaping and leaking from the housing 12 of the hydraulic motor 10. In order to accomplish this, the preferred embodiment provides a means for sealing the shaft 20 with respect to the housing 12 and a means for draining excess hydraulic fluid that may undesirably accumulate in the housing 12.

As seen in FIG. 1, the shaft 20 extends from the third journal 92 to a fourth journal 104 which is spaced along the longitudinal axis 22 between the third journal 92 and the output end 16 of the housing 12. Again, the third journal 92 and the fourth journal 104 of the shaft 20 are integrally connected by a narrowed neck region 106 of the shaft 20. The narrowed neck region 106 enhances the flow of hydraulic fluid for proper lubrication. A first conventional mechanical face seal 108 is coupled to the fourth journal 104 of the shaft 20. The first mechanical face seal 108 has a metallic annular ring portion 110 with a flexible O-ring 112 seated in a groove 114 of the annular ring portion 110 for sealing against the outer diameter of the shaft 20. A second conventional mechanical face seal 116 is coupled to the shaft 20 adjacent the first mechanical face seal 108 and spaced along the longitudinal axis 22 toward the output end 16 of the housing 12. The second mechanical face seal 116 also has a metallic annular ring 118 press fitted against the shaft 20 and a flexible O-ring seated 120 in an outer groove 122 of the annular ring 118 of the second mechanical face seal 116. The O-ring 120 of the second mechanical face seal 116 engages a bearing/seal support 124 which supports and retains the first and second mechanical face seals 108, 116 and the ball bearing 94 in a predetermined position.

The bearing/seal support 124 is a cylindrical member that is disposed within the opening 14 of the housing 12 and is coaxially aligned with the longitudinal axis 22 of the housing 12. The bearing/seal support 124 has a bottom portion 126 that contacts the ball bearing 94 and retains the ball bearing 94 in a predetermined position within the housing 12. A snap-ring 128 retains the bearing/seal support 124 within the opening 14 of the housing 12. The snap-ring 128 is seated in an interior groove 130 of the interior wall 96 of the housing 12 so that the snap-ring 128 extends outward from the interior walls 96 of the housing 12 and over a portion of the bearing/seal support 124. An additional groove 132 within the interior wall 96 of the housing 12 is also provided to seat a flexible O-ring 134 for engaging the outer wall of the bearing/seal support 124 and sealing the bearing/seal support 124 with respect to the opening 14 of the housing 12.

The draining means is provided to relieve hydraulic pressure that may accumulate within reservoir portions of the housing 12. A passageway 136 is defined by an aperture 138 provided in the side wall 140 of the housing 12 and a commonly aligned annular aperture 142 provided in a bottom portion of the bearing/seal support 124. The passageway 136 provides direct access to reservoir portions of the housing 12 located adjacent to the ball bearing 94. Hydraulic pressure is relieved by allowing hydraulic fluid to freely flow through the passageway 136 to an external fluid reservoir (not shown) where the hydraulic fluid may be recirculated within the hydraulic fluid system.

In an additional embodiment, an additional sealing means is provided as an added protection for prohibiting the escape of hydraulic fluid in high hydraulic pressure applications that cannot tolerate any leaking of hydraulic fluid. The first and second mechanical face seals 108, 116 are similarly situated, as shown in FIG. 2, but a lip seal 144 is added at the output end 16 of the housing 12. The lip seal 144 is coupled to the shaft 20 and seals the shaft 20 with respect to the housing 18. The lip seal 144 is spaced along the longitudinal axis 22 between the second mechanical face seal 116 and the output end 16 of the housing 12. A bearing/seal support 146, which has a slightly different structural configuration that the bearing/seal support 124 shown in FIG. 1, supports and retains the lip seal 144 in a predetermined position.

To accumulate any hydraulic fluid that may pass the first and second mechanical face seals 108, 116 and travel along the shaft 20, a small fluid compartment 148 is formed and defined by the lip seal 144, the seal/bearing support 146, the second mechanical face seal 116 and the shaft 20. To drain the fluid compartment 148, a passageway 150 extends through the bearing/seal support 146 for communicating hydraulic fluid from the fluid compartment 148 to the aperture 138 provided in the side wall 140 of the housing 12. The hydraulic fluid is directed to an outside fluid reservoir wherein the hydraulic fluid may be recirculated into the hydraulic fluid system. An additional flexible O-ring 152 may be provided at the bottom portion of the bearing/seal support 146 wherein an annular inner groove 154 is provided in the inner walls 96 of the housing 12 to seat the O-ring 152 and seal the outer surface of the bearing/seal support 146 from the opening 14 of the housing 12.

Figure 4:
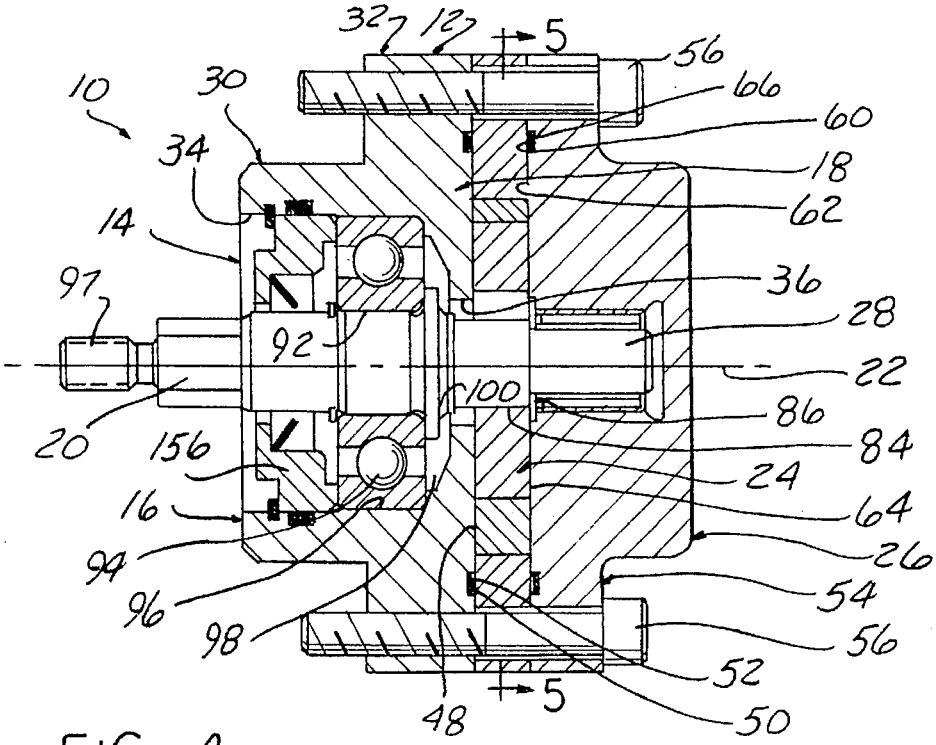
FIG. 4 is a sectional view showing the lip seal of the hydraulic motor utilized for low hydraulic pressures.

In an additional embodiment, hydraulic fluid is supplied to the gerotor 24 under low hydraulic pressure, such as 50 psig. Such low levels of hydraulic pressure do not pose the same sealing problems as the higher hydraulic pressures, and therefore, they do not require the extensive sealing arrangements disclosed in the previous embodiments. As seen in FIG. 4, only the lip seal 144 is utilized to seal the shaft 20 from the opening 14 of the housing 12. A seal/bearing support 156 supports and retains the lip seal 144 in a predetermined position, and the bearing/seal support 156 maintains the ball bearing 94 in a seated position within the opening 14 of the housing 12. As previously described, the seal/bearing support 156 is retained in the opening 14 of the housing 12 by the snap-ring 128 which is seated in the inner groove 130 provided in the inner wall 96 of the housing 12. The flexible O-ring 134 is also seated in the inner groove 132 of the housing 12 and engages the outer surface of the bearing/seal support 156 to seal the bearing/seal support 156 from the opening 14 of the housing 12.

Figure 7:
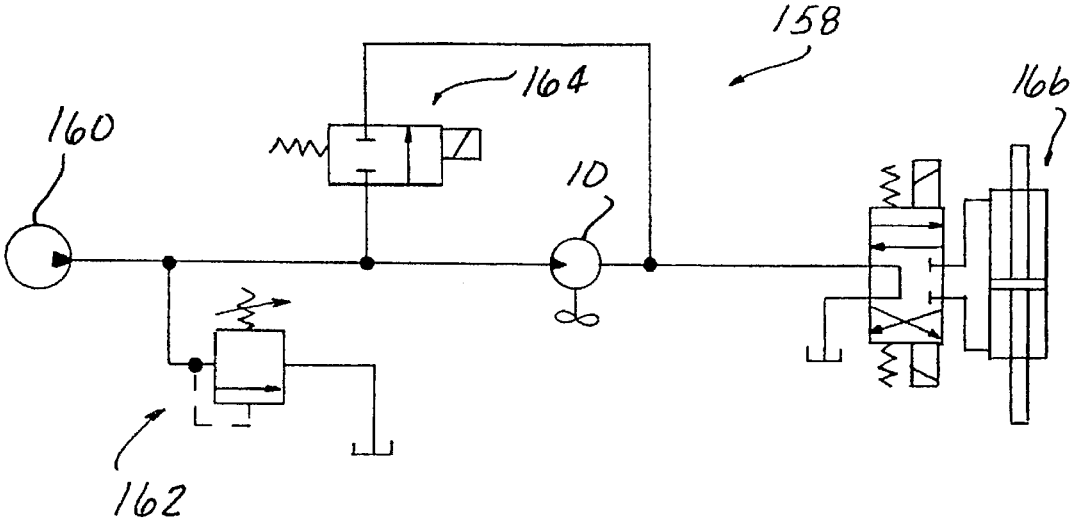
FIG. 7 is a schematic diagram showing the circuit in which the hydraulic motor of the present invention is utilized to power a steering gear assembly of a vehicle.

All three embodiments operate in a similar manner regardless of the level of hydraulic pressure provided to the hydraulic fluid. As seen in FIG. 7, the hydraulic motor 10 may be attached to a steering gear circuit 158 as shown. A pump 160 pumps hydraulic fluid to the hydraulic motor 10, and a relief valve 162 and a directional valve 164 may be utilized to manipulate hydraulic fluid between the pump 160 and the hydraulic motor 12. Hydraulic fluid is pumped into the inlet port 68 under a predetermined hydraulic pressure, and the pressurized hydraulic fluid drives the rotation of the inner and outer tooth gears 40, 42 of the gerotor 24 by pumping hydraulic fluid into the expanding actuating chambers 46. After the gears 40, 43 rotate 90°, the actuating chambers 46 begin to decrease in volume. The hydraulic fluid is then dispensed through the outlet port 70 after the gears 40, 42 have rotated 180°. The meshing of the gears 40, 42 within the gerotor 24 drives the shaft 20 of the hydraulic motor 10. The output end 97 of the shaft 20 extends beyond the output end 16 of the housing 12 and is coupled to a pulley (not shown) of a steering gear assembly 168 which in turn powers the steering gear assembly 168. For high pressure applications, a hose or vacuum (not shown) may be connected to the aperture 138 extending through the side wall 140 of the housing 12 in order that excess hydraulic fluid may be drained from the predetermined areas within the housing 12 to relieve the internal hydraulic pressure that may build due to the accumulation of hydraulic fluid.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A hydraulic motor comprising:

a housing having an output end and an input end and having an opening extending therebetween;

a shaft extending through said opening along a longitudinal axis of said housing;

a gerotor connected to said input end of said housing and having an outer tooth gear coaxially mounted to said shaft and an inner tooth gear meshing with said outer tooth gear for forming at least one actuating chamber;

a cover connected to and covering said gerotor and rotatably supporting one end of said shaft;

means for communicating a fluid to and from said at least one actuating chamber of said gerotor;

means for rotatably supporting said shaft in said housing;

a first seal disposed in said housing and spaced along said longitudinal axis between said rotatable supporting means and said output end of said housing;

a second seal disposed in said housing and spaced along said longitudinal axis between said first seal and said output end of said housing; and a third seal disposed in said housing and spaced along said longitudinal axis between said second seal and said output end of said housing.

2. The hydraulic motor stated in claim 1, wherein said third seal comprises a lip seal.

3. A hydraulic motor comprising:

a housing having an output end and an input end and having an opening extending therebetween along a longitudinal axis of said housing;

a shaft coaxially extending through said opening along said longitudinal axis, and said shaft having an input end extending beyond said input end of said housing;

a gerotor connected to said input end of said housing and having an outer tooth gear coaxially mounted to said shaft and an inner tooth gear machined with said outer tooth gear for forming at least one actuating chamber;

a cover connected to and covering said gerotor, and said cover receiving and rotatably supporting said input end of said shaft;

said cover having an inlet port for providing a high pressure fluid to said at least one actuating chamber of said gerotor and an outlet port for receiving a lower pressure fluid from said at least one actuating chamber of said gerotor;

first means for rotatably supporting said shaft in said housing;

means for sealing said shaft with respect to said opening of said housing, and said sealing means disposed in said opening in said housing and spaced along said longitudinal axis between said rotatable supporting means and said output end of said housing;

second means for supporting and retaining said rotatable supporting means and said sealing means in a predetermined position within said opening of said housing;

said sealing means including a first seal sealing said shaft with respect to said opening of said housing, and said first seal disposed in said opening of said housing and spaced along said longitudinal axis between said first rotatable supporting means and said output end of said housing;

a second seal sealing said shaft with respect to said opening of said housing, and said second seal disposed in said opening of said housing and spaced along said longitudinal axis between said first seal and said output end of said housing; and a third seal sealing said shaft relative to said opening of said housing, and said third seal disposed in said opening of said housing and spaced along said longitudinal axis between said second seal and said output end of said housing.

4. The hydraulic motor stated in claim 3, wherein said third seal is a lip seal.

5. A hydraulic motor comprising:

a housing having an output end and an input end and having an opening extending therebetween along a longitudinal axis of said housing;

a shaft coaxially extending through said opening along said longitudinal axis, and said shaft having an input end extending beyond said input end of said housing;

a gerotor connected to said input end of said housing and having an outer tooth gear coaxially mounted to said shaft and an inner tooth gear meshing with said outer tooth gear for forming at least one actuating chamber;

a cover connected to and covering said gerotor, and said cover receiving and rotatably supporting said input end of said shaft;

said cover having an inlet port for providing a high pressure fluid to said at least one actuating chamber of said gerotor and an outlet port for receiving a lower pressure fluid from said at least one actuating chamber of said gerotor;

first means for rotatably supporting said shaft in said housing;

means for sealing said shaft with respect to said opening of said housing, and said sealing means disposed in said opening in said housing and spaced along said longitudinal axis between said rotatable supporting means and said output end of said housing;

second means for supporting said rotatable supporting means and said sealing means for retaining said rotatable supporting means and said sealing means in a predetermined position within said opening of said housing;

means, separate from said inlet port and said outlet port, for draining excess fluid from a predetermined area within said housing to a fluid reservoir wherein said draining means is spaced along said longitudinal axis between said first rotatable supporting means and said output end of said housing; and a passageway extending through said housing and through said second supporting means for draining excess fluid from a predetermined area within said housing to a fluid reservoir.

6. A hydraulic motor comprising:

a housing having an output end and an input end and having an opening extending therebetween along a longitudinal axis of said housing;

a shaft coaxially extending through said opening along said longitudinal axis, and said shaft having an input end extending beyond said input end of said housing;

a gerotor connected to said input end of said housing and having an outer tooth gear coaxially mounted to said shaft and an inner tooth gear meshing with said outer tooth gear for forming at least one actuating chamber;

a cover connected to and covering said gerotor, and said cover receiving and rotatably supporting said input end of said shaft;

said cover having an inlet port for providing a high pressure fluid to said at least one actuating chamber of said gerotor and an outlet port for receiving a lower pressure fluid from said at least one actuating chamber of said gerotor;

first means for rotatably supporting said shaft in said housing;

means for sealing said shaft with respect to said opening of said housing, and said sealing means disposed in said opening in said housing and spaced along said longitudinal axis between said rotatable supporting means and said output end of said housing;

second means for supporting said rotatable supporting means and said sealing means for retaining said rotatable supporting means and said sealing means in a predetermined position within said opening of said housing;

means, separate from said inlet port and said outlet port, for draining excess fluid from a predetermined area within said housing to a fluid reservoir wherein said second supporting means is disposed in said opening of said housing; and a passageway extending through said housing and through said second supporting means for draining fluid from a predetermined area in said housing to a fluid reservoir wherein said predetermined area is spaced along said longitudinal axis between said second seal and said third seal.

7. The hydraulic motor comprising:

a housing having an output end and an input end and having an opening extending therebetween along a longitudinal axis of said housing;

a shaft extending through said opening coaxially along said longitudinal axis, and said shaft having an input end extending beyond said input end of said housing;

a gerotor connected to said input end of said housing and having an outer tooth gear coaxially mounted to said shaft and an inner tooth gear meshing with said outer tooth gear for forming at least one actuating chamber;

a cover connected to and covering said gerotor and said cover receiving and rotatably supporting said input end of said shaft;

said cover having an inlet port for providing a high pressure fluid to said at least one actuating chamber of said gerotor and an outlet port for receiving a lower pressure fluid from said at least one actuating chamber of said gerotor;

a roller bearing coaxially mounted to said shaft and seated in said opening of said housing for rotatably supporting said shaft;

a first mechanical face seal for sealing said shaft with respect to said opening of said housing, and said first mechanical face seal located in said opening of said housing and spaced along said longitudinal axis between said roller bearing and said output end of said housing;

a second mechanical face seal for sealing said shaft with respect to said opening of said housing, and said second mechanical face seal disposed in said opening of said housing and spaced along said longitudinal axis between said first mechanical face seal and said output end of said housing;

a lip seal for sealing said shaft with respect to said opening of said housing, and said lip seal disposed in said opening of said housing and spaced along said longitudinal axis between said second mechanical face seal and said output end of said housing;

a bearing/seal support disposed in said opening of said housing for supporting and retaining said bearing, said first face seal, said second face seal and said lip seal in a predetermined position;

a fluid compartment defined by said shaft, said bearing/seal support, said second face seal and said lip seal for accumulating fluid that passes said first mechanical face seal and said second mechanical face seal; and a passageway extending through said housing and said bearing/seal support for draining said accumulated fluid from said fluid compartment to a fuel reservoir.

8. The hydraulic motor stated in claim 7, including an output end of said shaft extending beyond said output end of said housing and being coupled to means for accomplishing work.

9. The hydraulic motor stated in claim 8, wherein said work means comprises a steering gear assembly of a vehicle.

10. The hydraulic motor stated in claim 7, including a pump for providing pressurized hydraulic fluid to said inlet port.

* * * * *